US007135648B2

(12) United States Patent
Schnedl et al.

(10) Patent No.: US 7,135,648 B2
(45) Date of Patent: Nov. 14, 2006

(54) END POSITION DETECTOR FOR MOVABLE SWITCH PARTS

(75) Inventors: Karl Schnedl, Knittelfeld (AT); Armin Lassacher, Murau (AT)

(73) Assignees: VAE Eisenbahnsysteme GmbH, Zeltweg (AT); VAE GmbH, Vienna (AT)

( * ) Notice: Subject to any disclaimer, the term of this patent is extended or adjusted under 35 U.S.C. 154(b) by 0 days.

(21) Appl. No.: 10/523,090

(22) PCT Filed: Jul. 31, 2003

(86) PCT No.: PCT/AT03/00218

§ 371 (c)(1),
(2), (4) Date: Feb. 2, 2005

(87) PCT Pub. No.: WO2004/014710

PCT Pub. Date: Feb. 19, 2004

(65) Prior Publication Data

US 2006/0021862 A1 Feb. 2, 2006

(30) Foreign Application Priority Data

Aug. 7, 2002 (AT) ..... A 1196/2002

(51) Int. Cl.

| | |
|---|---|
| ***H01H 15/14*** | (2006.01) |
| ***H01H 17/12*** | (2006.01) |
| ***H01H 19/18*** | (2006.01) |
| ***H01H 21/28*** | (2006.01) |
| ***H01H 3/16*** | (2006.01) |

(52) U.S. Cl. ..... 200/47; 246/449; 246/220

(58) Field of Classification Search ..... 200/33 B, 200/33 D, 47, 334, 573, 574; 246/449, 220
See application file for complete search history.

(56) References Cited

U.S. PATENT DOCUMENTS

| | | | | |
|---|---|---|---|---|
| 2,740,041 | A * | 3/1956 | Marcum | 246/220 |
| 3,192,350 | A * | 6/1965 | Horberg, Jr. | 200/47 |
| 3,898,399 | A * | 8/1975 | Yasui et al. | 200/47 |
| 4,133,111 | A * | 1/1979 | Logan | 33/1 M |
| 5,669,587 | A | 9/1997 | Van Alstine et al. | |
| 6,648,276 | B1 * | 11/2003 | McQuistian | 246/452 |

FOREIGN PATENT DOCUMENTS

| | | |
|---|---|---|
| DE | 3115943 A1 | 11/1982 |
| WO | WO 00/73119 A1 | 12/2000 |
| WO | WO 01/15955 A1 | 3/2001 |

* cited by examiner

*Primary Examiner*—Elvin Enad
*Assistant Examiner*—Lheiren Mae A. Anglo
(74) *Attorney, Agent, or Firm*—Chapman and Cutler LLP

(57) ABSTRACT

The invention pertains to an end position detector for movable switch parts (3) which comprises a rod assembly and a housing (12), into which the rod assembly penetrates and in which at least one sensor for sensing an end position of the rod assembly is arranged. According to the invention, the rod assembly is connected to the movable switch part (3) such that it can be pivoted in a vertical plane that lies transverse to the longitudinal direction of the rails, wherein the rod assembly comprises at least one rod (8) of circular cross section, and wherein said rod (8) in its region that penetrates into the housing (12) in a sealed fashion carries on its periphery at least one switching flank (13) that cooperates with a switch contact (16).

19 Claims, 5 Drawing Sheets

END POSITION DETECTOR FOR MOVABLE SWITCH PARTS

The invention pertains to an end position detector for movable switch parts which comprises a rod assembly and a housing, into which the rod assembly penetrates and in which at least one sensor for sensing an end position of the rod assembly is arranged.

Switch operating devices for movable switch parts, in particular tongue blades or switch points, which are provided with an end position detector are generally known from the pertinent state of the art. In known switch operating devices, the movable switch part is mechanically driven with the aid of an electric or hydraulic switch drive. In addition, a separate interlocking device or an interlocking device that is integrated into the switch drive, as well as a separate end position detector, is provided. End position detectors of this type are used for mechanically sensing the current state of the switch and for generating a signal, based on which it can be reliably ascertained if the switch was correctly shifted and whether the closed tongue and the open tongue are respectively situated in their correct end position or not. The end position detector comprises a rod assembly that essentially extends transverse to the longitudinal direction of the rails and is displaced in the longitudinal direction of the rod assembly when the switch is shifted. The position of the rods is determined with the aid of electromechanical transducers that, for example, are realized in the form of proximity switches or switch contacts and usually arranged in a housing that is mounted laterally of the switch on a sleeper.

In addition to the embodiment, in which the end position detector is realized in the form of a separate unit, it has also been proposed to integrate the end position detector into a common housing together with the switch drive, for example, in DE 1755105. DE 29917829 U1 discloses a different embodiment with a continuous rod, the two rod sections of which can be telescopically extended in a spring-loaded fashion. In this case, the end position contact switches are realized in the form of switching fingers that are rigidly connected to the rod and cooperate with proximity switches. In alternative solutions, the rod is provided with grooves, into which switching levers engage such that they are able to trigger the end position switch. One example of such an embodiment is disclosed in U.S. Pat. No. 5,669,587.

However, known end position detectors have one common disadvantage, namely that their functional integrity depends on a series of external factors that cannot be directly influenced. For example, the vibrations of the movable switch part which are produced when a train travels over the switch can be transmitted onto the rod assembly and lead to malfunctions or the faulty triggering of the end position contact switches. In addition, mechanical tensions in the rod assembly or even distortions thereof may occur as a result of changes in the interconnected mass, for example, thermal expansions of the tongue blade. These mechanical tensions or distortions not only result in an increased friction between the rod assembly and the housing, but may also cause the rod assembly to become jammed or tilted. In any case, the proper function of the end position detector is significantly impaired.

The present invention is based on the objective of developing an end position detector that delivers reliable switching signals independently of external influences, wherein an exact adaptation to the respective travel stroke of the movable switch part can be realized, and wherein even slight deviations from the end position result in the end position switch not being actuated. In addition, the end position detector should have a compact design and, in particular, have such dimensions that it can be installed in a trough-like sleeper.

According to the invention, this objective is attained by essentially realizing the end position detector in such a way that the rod assembly is connected to the movable switch part such that it can be pivoted in a vertical plane that lies transverse to the longitudinal direction of the rails, and that the rod assembly comprises at least one rod of circular cross section which in its region that penetrates into the housing in a sealed fashion carries on its periphery at least one switching flank that cooperates with the switch contact. Since the rod assembly is connected to the movable switch part such that it can be pivoted in a vertical plane that lies transverse to the longitudinal direction of the rails and the pivot support is preferably realized by utilizing elastic connecting elements and/or spherical bearings, vibrations of the tongue blade or the switch point are compensated and not transmitted onto the rod. This means that such vibrations alone can no longer trigger the end position switch, and that the reliability of the detector can be improved. The tilting moments which additionally act upon the movable parts while a train travels over the switch can also be absorbed due to the ability to pivot the rod assembly about an axis that essentially extends in the longitudinal direction of the rails in the joint or in the elastic connecting element.

It is also impossible to prevent torsional moments from acting upon the rod assembly. This is the reason why the invention proposes that the rod assembly comprises at least one rod of circular cross section that carries on its periphery at least one switching flank that cooperates with a switch contact, namely in the region that penetrates into the housing in a sealed fashion. Due to this configuration, the functional integrity of the end position detector also remains unaffected under torsional stresses or if the rod assembly, in particular the rod of circular cross section, is distorted. The circular cross section of the rod ensures that the housing always remains sealed in the region, in which the rod penetrates into the housing. In addition, the switching flank that is arranged in this region and cooperates with a switch contact ensures that the end position switch is only actuated in the exact end position, namely independently of interfering external influences.

In one preferred embodiment of the end position detector according to the invention, the housing is connected to a stationary part of the switch such that it can be pivoted in a vertical plane that lies transverse to the longitudinal direction of the rails. This means that a pivot support about an axis that extends in the longitudinal direction of the rails, i.e., in a vertical plane that lies transverse to the longitudinal direction of the rails, is not only realized on the rail side, but also on the side situated opposite of the movable switch part. This flexible support makes it possible to even better isolate the end position detector from tilting moments, vibrations or other mechanical tensions. In this case, the housing is connected to a stationary part in a pivoted fashion, wherein the sleeper or trough-like sleeper usually serves as the stationary part.

According to one preferred embodiment, another improvement is achieved by connecting the rod assembly to the movable switch part such that it can be displaced in the longitudinal direction of the rails. This embodiment also pertains to the mounting of the rod assembly on the rail side. Since the rod assembly can be longitudinally displaced relative to the movable switch part, this embodiment makes it possible to take into account that tongue blades and switch points are subjected to thermal expansions. However, these thermal expansions cannot be transferred onto the rod assembly because this would impair the proper function of the end position detector and its ability to precisely sense the end position. With respect to constructive considerations, this is advantageously realized in such a way that the rod assembly is connected to a vertical bolt that is guided in a sliding fashion in an oblong hole, wherein this oblong hole essentially extends in the longitudinal direction of the rails and is arranged in a base plate of the movable switch part. The oblong hole makes it possible to longitudinally displace the rod assembly relative to the movable switch part. Since the connection between the rod assembly and the base plate containing the oblong hole is produced with the aid of a vertical bolt, the rod assembly can be simultaneously pivoted about an axis that lies perpendicular to the plane of the rails such that a certain flexibility is also achieved in this respect.

The pivot support or flexibility of the end position detector on the rail side as well as the side of the housing naturally cannot cause any play or flexibility in the direction of the travel stroke, i.e., in the longitudinal direction of the rod, because an exact detection of the end position would otherwise be impossible. Consequently, the individual bearing points need to be realized in such a way that the travel movement of the movable rail part is directly transmitted onto the rod assembly. In this context, the coupling of the rod assembly on the rail side is advantageously realized in such a way that the bolt contains a spherical contact surface or carries a sliding ring with spherical contact surface in the region of its section that penetrates into the oblong hole. According to another preferred embodiment, the rod is connected to the bolt in an angularly rigid fashion, preferably at an angle of 90°, via a connecting element.

When a train travels over a switch, it is impossible to prevent the movable switch part, i.e., the tongue blade or the switch point, from being lowered and raised under the influence of the rolling load. This is the reason why the end position detector according to the invention is advantageously realized in such a way that the rod or the connecting element engages on the bolt via spring elements that act in the direction of the longitudinal axis of the bolt. This makes it possible to also absorb these vertical movements of the movable switch part, namely without subjecting the rod to excessive mechanical stresses that could cause the rod to tilt or jam in the housing.

In order to precisely adapt the end position detector to the respective travel stroke of the switch, the invention proposes that the switching flank can be adjusted in the axial direction of the rod, wherein the switching flank is advantageously realized in the form of the end face of a tube that can be screwed on the rod. This means that the axial length of the switching flank can be varied and adapted to the respective travel stroke by turning the tube. However, it would also be conceivable to realize a direct adjustment. In this case, the effective length of the rod can be varied and adapted to the respective travel stroke of the movable switch part, wherein the rod is preferably provided with an outside thread on its end that faces the movable switch part such that it can be screwed into an inside thread of a part that is connected to the movable switch part, preferably the connecting element, and fixed in the respective position.

According to another advantageous embodiment, the rod is prevented from tilting or jamming due to the fact that the housing comprises a guide tube, the length of which is greater than the maximum travel stroke of the movable switch part and in which the rod is guided in a sliding fashion. The sliding guidance of the rod in the guide tube results in an axial guidance over a distance that is greater than the maximum travel stroke of the movable switch part. Consequently, the switching flank that is arranged on the rod assembly and cooperates with a switch contact is situated within the guide tube independently of the respective position of the movable switch part. Due to these measures, the sensitive region of the end position switch is protected from dirt and the precise interaction with the switch is not impaired. In this case, the switch is realized with a spring-loaded plunger that engages into the groove defined by the switching flank in the correct end position of the movable switch part. Due to this design, the spring-loaded plunger only engages in the correct end position and only into the groove defined by the switching flank in order to trigger the switching process of the end position switch with positive opening operation and to signal the correct end position of the movable switch part to a distant monitoring station. Since the rod length and the axial position of the switching flank can also be adapted to the respective travel stroke, it is possible to exactly place the switching flank at the position required for the cooperation with the spring-controlled switch. In any other incorrect end position of the monitored part, the plunger is positively actuated by the rod such that the switch is also positively opened and the reaching of the correct end position is not signalled, namely independently of the fact how slightly the rod is spaced apart from this end position.

The end position detector can be realized in a very compact fashion, wherein a particularly protected arrangement is achieved if the rod assembly and the housing are, according to one preferred embodiment, accommodated in a trough-like sleeper or in a stationary switch part.

The invention is described in greater detail below with reference to one embodiment that is schematically illustrated in the figures.

Figure 1:
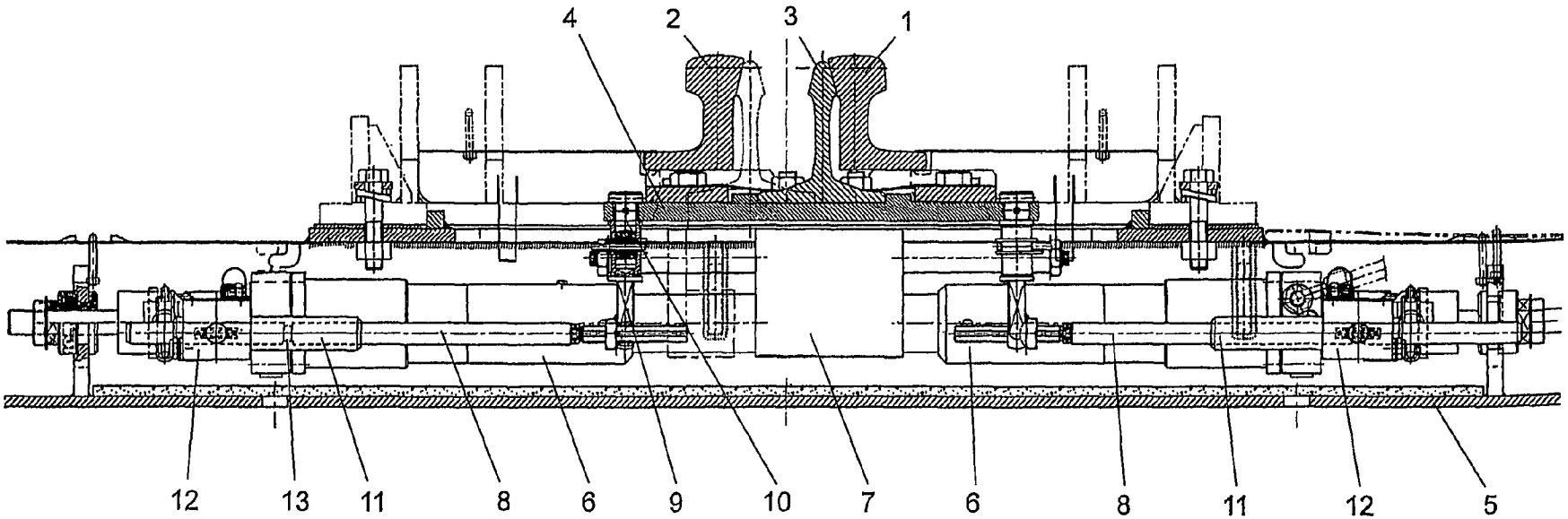
FIG. 1 shows a vertical section through a switch with a movable switch point and an end position detector arranged in the trough-like sleeper.

FIG. 1 shows a vertical section through a switch, wherein the reference signs 1 and 2 identify the guardrails and the reference sign 3 identifies the movable switch point. This movable switch point is illustrated with continuous lines in the position in which it adjoins the guardrail 1 and with broken lines in the position in which it adjoins the guardrail 2. The switch point 3 is connected to a base plate 4 that is supported on the slide chair of a trough-like sleeper 5. In order to shift the switch point 3 between the two contact positions or end positions, a driving device 6 is provided which is connected to the base plate 4 by means of a coupling element 7 that is not illustrated in greater detail. The end position detector is realized separately of the driving device and comprises a rod 8 that is coupled to the base plate 4 by means of an intermediate element 9 and a bolt 10. The rod 8 penetrates into a guide tube 11 that forms part of the housing 12. A switch contact for detecting the correct end position of the rod assembly is arranged in the housing 12 as described in greater detail below, wherein the switch contact cooperates with a switching flank 13 arranged on the rod 8. The switch point 3 is connected to a separate end position detector for each end position, wherein the end position detector illustrated on the right in this figure serves for determining whether the switch point 3 adjoins the guardrail 1 and the end position detector illustrated on the left serves for determining whether the switch point adjoins the guardrail 2.

Figure 2:
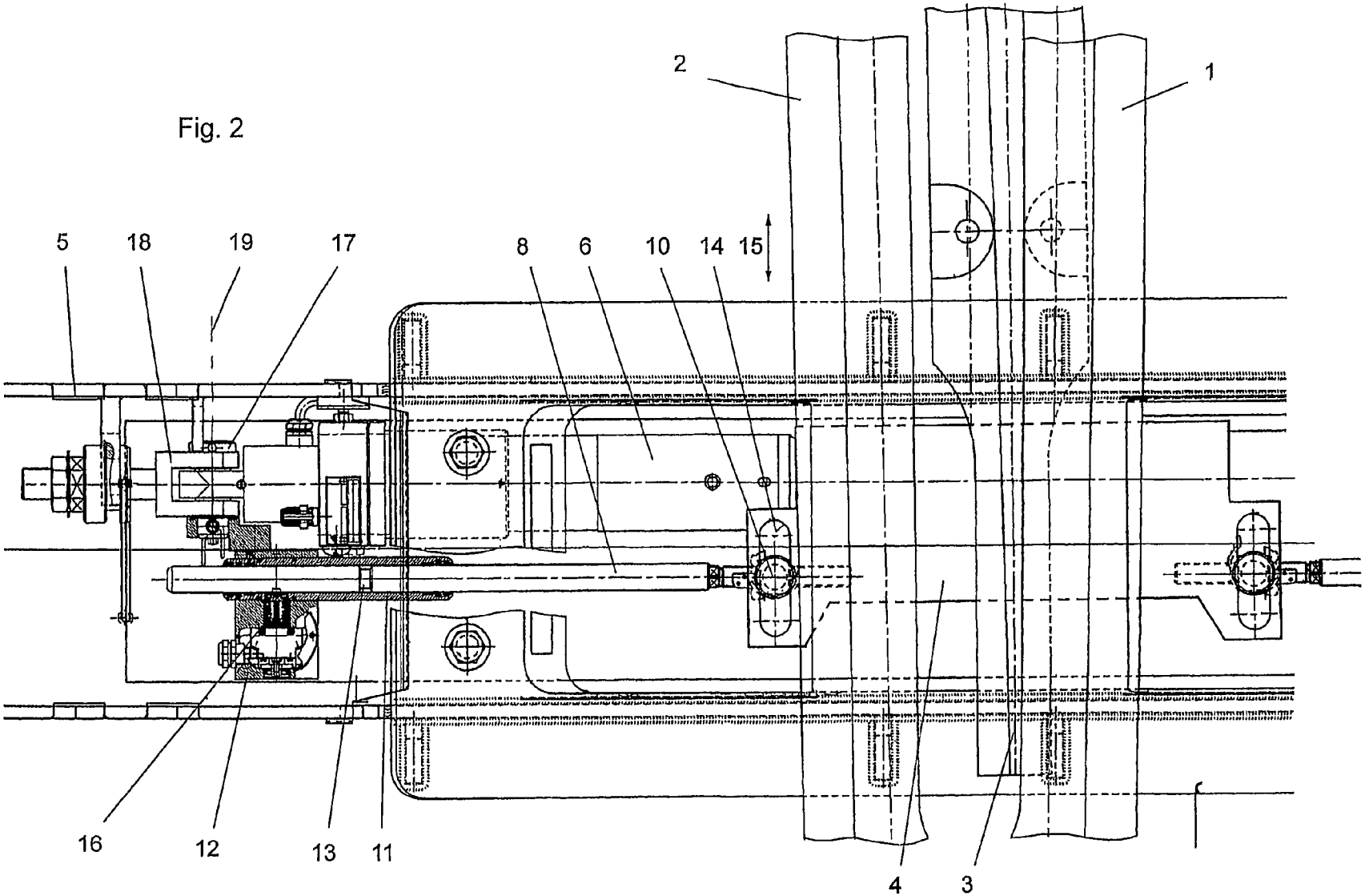
FIG. 2 shows a top view of the switch according to FIG. 1.

FIG. 2 shows an enlarged top view of the end position detector according to the invention, wherein certain components that are not required for comprehending the invention and do not form part of the end position detector were omitted in order to provide a better overview. The reference sign 3 identifies the switch point that is fixed on the base plate 4. This top view indicates that the base plate 4 is provided with an oblong hole 14, in which the bolt 10 is guided such that it can be longitudinally displaced in the direction of the double arrow 15. The rod 8 penetrates into the guide tube 11 that forms part of the housing 12. The housing 12 accommodates an end position switch 16 that engages into the groove defined by the switching flank 13 when the correct end position is reached and transmits a corresponding signal to a distant monitoring station. A bolt 17 connects the housing 12 to a stationary part of the trough-like sleeper 5, namely the fork section 18, in an articulated fashion such that the housing can be pivoted about the axis 19. The fork section 18 also serves for realizing the stationary coupling of the switch drive 6.

Figure 3:
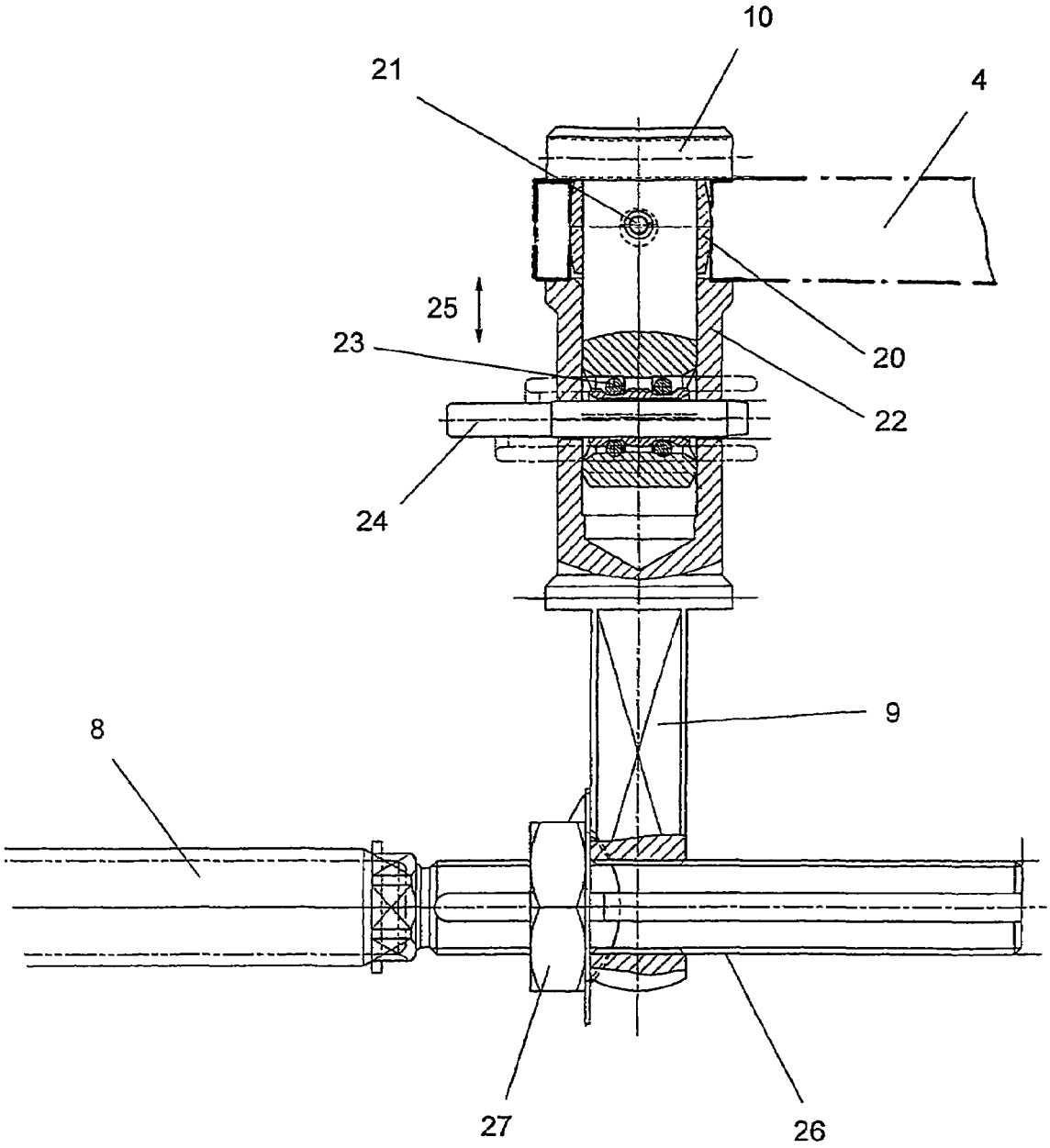
FIG. 3 shows a detail of the rod coupling on the rail side.

FIG. 3 shows an enlarged representation of the coupling of the rod 8 on the rail side. As mentioned above, the bolt 10 penetrates into the oblong hole 14 of the base plate 4, wherein this figure indicates that the bolt 10 carries spherical contact surfaces 20 in order to enable the bolt to pivot relative to the base plate 4 about the axes 21 that essentially extend in the longitudinal direction of the rails. The bolt 10 is secured by means of a counterpart 22, wherein the bold 10 cooperates with a safety pin 24 via spring elements or seals 23 such that a relative displacement can be realized in the vertical direction as indicated by the double arrow 25. The connection with the rod 8 is realized with the aid of the intermediate element 9, wherein the rod 8 is provided with a thread 26 such that the effective length of the rod can be adapted to the respective travel stroke of the movable switch part by turning the rod. The lock nut 27 serves for securing the adjusted position of the rod. However, the adaptation to the travel stroke can also be realized with the arrangement illustrated in FIG. 5, in which the rod 8 may be rigidly connected to the connecting element 9.

Figure 4:
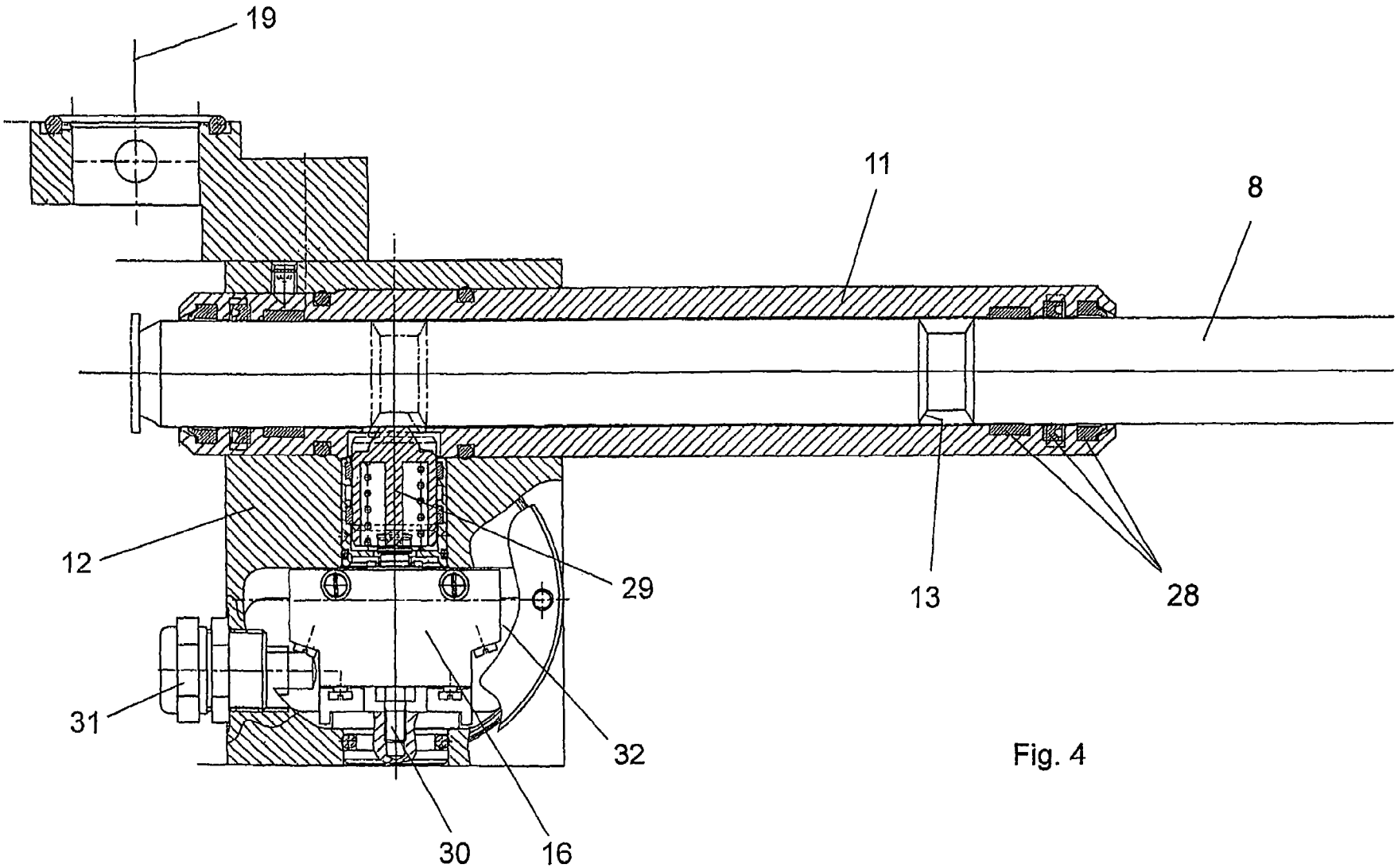
FIG. 4 shows a detail of the housing.

FIG. 4 shows an enlarged representation of the housing which indicates that the rod 8 penetrates into the guide tube 11 in a sealed fashion, namely with the aid of seals 28. The spring-controlled switch 16 that is equipped with a spring-loaded plunger 29 is arranged in the housing 12. The spring-loaded plunger 29 is able to engage into the groove defined by the switching flank 13, wherein the spring-controlled switch 16 is only able to signal that the correct end position is reached in this case. In all other instances, no switching signal is generated due to the positive opening operation of the switch. The precise adjustment of the switch is realized with the aid of the adjusting screw 30. The cable connector is identified by the reference sign 31. In order to allow an external inspection of the switch, the housing 12 is realized with a transparent cover 32 such that an additional on-site control can be carried out.

Figure 5:
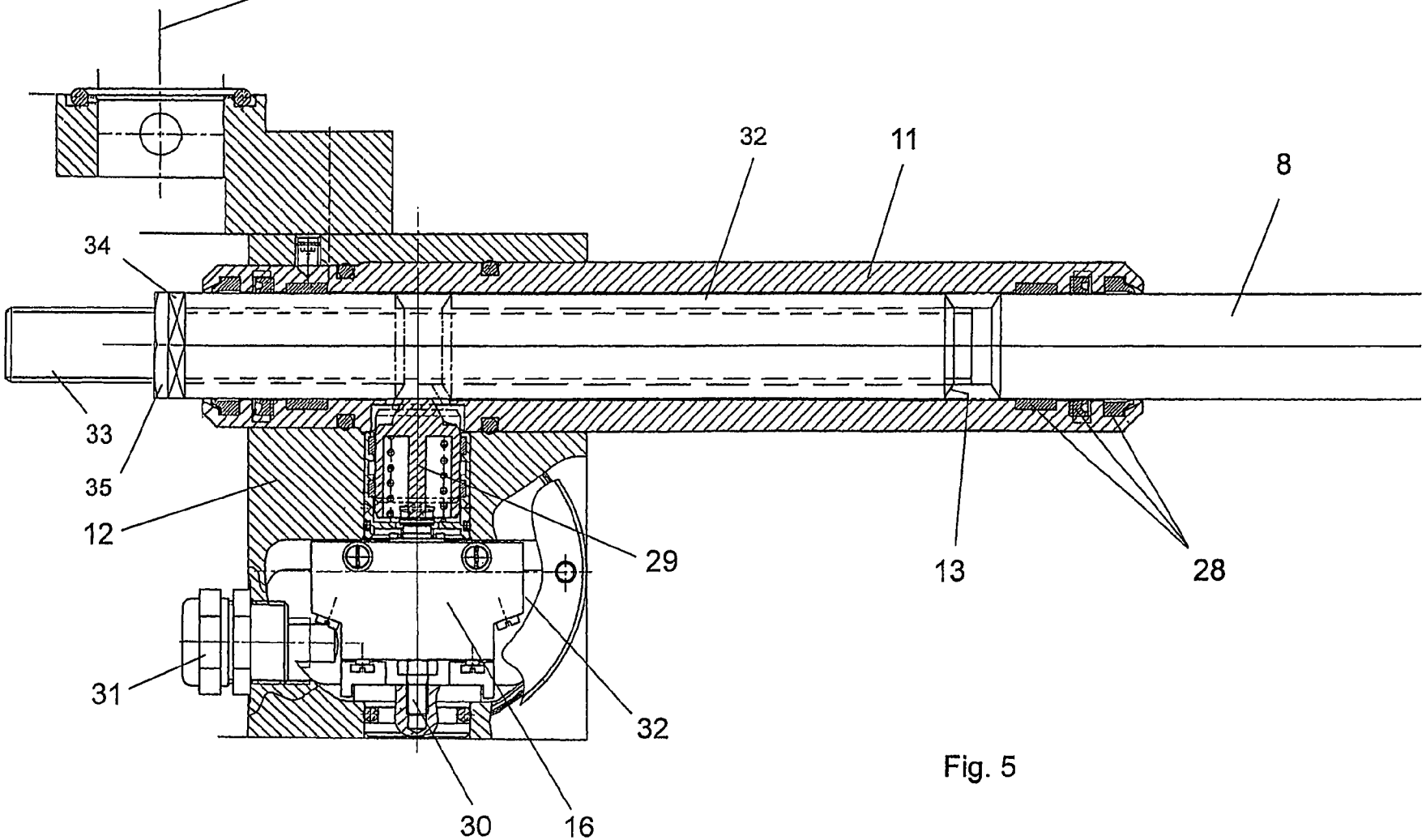
FIG. 5 shows a detail of a modified variation of the housing according to FIG. 4.

FIG. 5 shows a modified embodiment of the rod assembly section that penetrates into the housing 12. A tube 32 that carries the switching flank 13 on its end face is screwed on a threaded section 33 of the rod 8. This means that the position of the switching flank 13 can be axially adjusted and adapted to different travel strokes by turning the square part 34 of the tube 32. The lock nut 35 serves for fixing and securing the respectively adjusted position.

The invention claimed is:

1. An end position detector for movable switch parts, comprising a rod assembly and a housing, into which the rod assembly penetrates and in which at least one sensor for sensing an end position of the rod assembly is arranged, wherein the rod assembly is connected to a movable switch part (3) such that it is adapted to be pivoted in a vertical plane that lies transverse to a longitudinal direction of the movable switch part (3), the rod assembly comprises at least one rod (8) of circular cross section, wherein said rod (8) in a region of said rod (8) that penetrates into the housing (12) in a sealed fashion carries on a periphery of said rod (8) at least one switching flank (13) that cooperates with a switch (16), and the housing (12) is connected to a stationary part of the switch such that it is adapted to be pivoted in a vertical plane that lies transverse to the longitudinal direction of the movable switch part (3).

2. End position detector according to claim 1, wherein pivot support is achieved by utilizing elastic connecting elements or spherical bearings.

3. End position detector according to claim 1, wherein the rod assembly is connected to the movable switch part (3) such that it is adapted to be displaced in the longitudinal direction of the movable switch part (3).

4. End position detector according to claim 3, wherein pivot support is achieved by utilizing elastic connecting elements or spherical bearings.

5. End position detector according to claim 3, wherein the rod assembly is connected to a vertical bolt (10) that is guided in a sliding fashion in an oblong hole (14) that essentially extends in the longitudinal direction (15) of the movable switch part (3) and is arranged in a base plate (4) of the movable switch part (3).

6. End position detector according to claim 1, wherein the rod assembly is connected to a vertical bolt (10) that is guided in a sliding fashion in an oblong hole (14) that essentially extends in the longitudinal direction (15) of the movable switch part (3) and is arranged in a base plate (4) of the movable switch part (3).

7. End position detector according to claim 6, wherein the bolt (10) comprises a spherical contact surface (20) or a sliding ring with a spherical contact surface in a region of a section of said bolt (10) that penetrates into the oblong hole (14).

8. End position detector according to claim 6, wherein the rod (8) is connected to the bolt (10) in an angularly rigid fashion, via a connecting element (9).

9. End position detector according to claim 8, wherein the rod (8) is connected to the bolt (10) in an angularly rigid fashion at an angle of approximately 90°.

10. End position detector according to claim 6, wherein the rod (8) or a connecting element (9) engages on the bolt (10) via spring elements (23) that act in a direction of a longitudinal axis (25) of the bolt (10).

11. End position detector according to claim 6, wherein the rod assembly is connected to the movable switch part (3) such that it is adapted to be displaced in the longitudinal direction of the movable switch part (3).

12. End position detector according to claim 1, wherein the switching flank (13) is adapted to be adjusted in an axial direction of the rod (8).

13. End position detector according to claim 12, wherein the switching flank (13) is realized in the form of an end face of a tube (32) that is adapted to be screwed on the rod (8).

14. End position detector according to claim 1, wherein an effective length of the rod (8) is variable and adapted to a respective travel stroke of the movable switch part (3).

15. End position detector according to claim 1, wherein the rod (8) comprises an outside thread (26) on an end of said rod (8) that faces the movable switch part (3), and wherein the rod is adapted to be screwed into an inside thread of a part that is connected to the movable switch part (3), and fixed in a respective position.

16. End position detector according to claim 15, wherein the part that is connected to the movable switch part (3) is a connecting element (9).

17. End position detector according to claim 1, wherein the rod assembly and the housing (12) are accommodated in a trough-like sleeper (5) or in a stationary switch part.

18. End position detector according to claim 1, wherein the housing (12) comprises a guide tube (11), the length of which is greater than a maximum travel stroke of the movable switch part (3), wherein the rod (8) is guided in said guide tube in a sliding fashion.

19. End position detector according to any one of claims 1, 2, 3, 6, 7, 8, 10, 12, 13, 14, 15, 17 and 18, wherein the switch (16) comprises a spring-loaded plunger (29) that engages into a groove defined by the switching flank (13) in a correct end position of the movable switch part (3).

* * * * *